US011885108B2

(12) United States Patent
Anahara et al.

(10) Patent No.: US 11,885,108 B2
(45) Date of Patent: Jan. 30, 2024

(54) WORK MACHINE AND PERIPHERY MONITORING SYSTEM

(71) Applicant: HITACHI CONSTRUCTION MACHINERY CO., LTD., Tokyo (JP)

(72) Inventors: Keiichirou Anahara, Kasumigaura (JP); Naoki Hagiwara, Kasumigaura (JP); Kazuhiko Mizoguchi, Ishioka (JP); Akihiro Narazaki, Tsukuba (JP); Shinji Nishikawa, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 94 days.

(21) Appl. No.: 17/641,536

(22) PCT Filed: Oct. 28, 2020

(86) PCT No.: PCT/JP2020/040509
§ 371 (c)(1),
(2) Date: Mar. 9, 2022

(87) PCT Pub. No.: WO2021/085500
PCT Pub. Date: May 6, 2021

(65) Prior Publication Data

US 2022/0290411 A1 Sep. 15, 2022

(30) Foreign Application Priority Data

Oct. 31, 2019 (JP) ..... 2019-199394

(51) Int. Cl.
*E02F 9/26* (2006.01)
*E02F 9/20* (2006.01)
(Continued)

(52) U.S. Cl.
CPC ..... *E02F 9/262* (2013.01); *E02F 9/2033* (2013.01); *E02F 9/2285* (2013.01); *E02F 9/24* (2013.01); *E02F 9/265* (2013.01)

(58) Field of Classification Search
CPC ..... E02F 9/262; E02F 9/2033; E02F 9/2285; E02F 9/24; E02F 9/265
(Continued)

(56) References Cited

U.S. PATENT DOCUMENTS

2006/0137931 A1* 6/2006 Berg ..... B62D 1/12 180/333
2011/0192155 A1* 8/2011 Hagiwara ..... E02F 9/2285 60/421
(Continued)

FOREIGN PATENT DOCUMENTS

CN 1827928 A 9/2006
CN 107925745 A 4/2018
(Continued)

OTHER PUBLICATIONS

Chinese Office Action received in corresponding Chinese Application No. 202080063235.9 dated Oct. 27, 2022.
(Continued)

*Primary Examiner* — Kerri L Mcnally
*Assistant Examiner* — Thang D Tran
(74) *Attorney, Agent, or Firm* — Mattingly & Malur, PC

(57) ABSTRACT

In a hydraulic excavator including a machine body and a front work device, when an object is detected by sensors for detecting an object around the machine body when operation limiting control for limiting the operation of at least one of the machine body and the front work device is enabled, or when an operation device is operated, the detection of the object is notified to an operator by a first state warning, and when the operation limiting control is enabled and when the
(Continued)

operation device is not operated, the detection of the object is notified to the operator by a second state warning that is weaker in warning intensity than the first state warning. Accordingly, the botheration for the operator can be suppressed while securing the effectiveness of an alarm in periphery monitoring, and the safety performance can be enhanced.

5 Claims, 6 Drawing Sheets

(51) Int. Cl.
*E02F 9/22* (2006.01)
*E02F 9/24* (2006.01)

(58) Field of Classification Search
USPC ..... 340/438
See application file for complete search history.

(56) References Cited

U.S. PATENT DOCUMENTS

2012/0000191 A1* 1/2012 Hagiwara ..... B01D 46/42 60/311
2012/0003069 A1* 1/2012 Hagiwara ..... E02F 9/2285 414/685
2013/0035824 A1* 2/2013 Nakamura ..... E02F 9/267 701/36
2013/0160439 A1* 6/2013 Lee ..... E02F 9/2296 60/384
2013/0222573 A1* 8/2013 Onuma ..... G05B 9/02 348/82
2014/0118533 A1* 5/2014 Chang ..... E02F 9/261 348/118
2016/0318438 A1* 11/2016 Wadell ..... H05B 47/19
2017/0191243 A1* 7/2017 Sharp ..... E02F 9/261
2018/0178342 A1* 6/2018 Russell ..... G05B 19/402
2018/0209122 A1 7/2018 Kiyota et al.
2018/0238020 A1* 8/2018 Hirasawa ..... B60K 11/04
2018/0238021 A1* 8/2018 Inukai ..... E02F 9/00
2018/0266079 A1* 9/2018 Morita ..... E02F 9/2004
2018/0274206 A1* 9/2018 Kozui ..... E02F 9/262
2019/0024348 A1* 1/2019 Hiekata ..... E02F 9/24
2019/0241119 A1* 8/2019 Takeda ..... B60Q 1/30
2019/0249397 A1* 8/2019 Mizuno ..... E02F 9/26
2019/0284782 A1 9/2019 Izumikawa
2019/0352885 A1 11/2019 Kurokami et al.
2020/0291614 A1* 9/2020 Kiyota ..... B60R 1/00
2020/0392701 A1* 12/2020 Aizawa ..... H04N 7/181
2021/0174660 A1* 6/2021 Kamimura ..... E02F 9/26
2021/0214923 A1* 7/2021 Fujiwara ..... E02F 9/262
2022/0170236 A1* 6/2022 Shin ..... E02F 9/265

FOREIGN PATENT DOCUMENTS

CN 109689983 A 4/2019
JP 2004076351 A 3/2004
JP 2005248502 A 9/2005
JP 2017172223 A 9/2017
JP 2018111981 A 7/2018
JP 2019157409 A 9/2019
WO 2015/121818 A1 2/2015
WO 2018/105527 A1 6/2018
WO 2019/111859 A1 6/2019

OTHER PUBLICATIONS

International Preliminary Report on Patentability received in corresponding International Application No. PCT/JP2020/040509 dated May 12, 2022.
International Search Report of PCT/JP2020/040509 dated Jan. 19, 2021.

* cited by examiner

WORK MACHINE AND PERIPHERY MONITORING SYSTEM

TECHNICAL FIELD

The present invention relates to a work machine and a periphery monitoring system.

BACKGROUND ART

In a work machine such as a hydraulic excavator, a technique for supporting periphery monitoring of the work machine has been known as a technique relating to the driving assist of an operator. For example, Patent Document 1 discloses a peripheral monitoring system for a work machine in which an object detection unit for detecting a predetermined object existing in a predetermined range around a work machine and an alarm unit for issuing an alarm by sound when the object detection unit detects the object are provided, and the alarm unit stops the alarm sound when a predetermined condition is satisfied when the state in which the object detection unit detects the object continues and issues an alarm by light after the alarm sound is stopped.

PRIOR ART DOCUMENT

Patent Document

Patent Document 1: JP-2018-111981-A

SUMMARY OF THE INVENTION

Problem to be Solved by the Invention

In the prior art, the botheration for the operator is suppressed by switching the alarm sound to the alarm light in a situation where the operator recognizes that a predetermined object to be monitored exists around the work machine. However, for example, in a case where the visibility of the alarm by light from the operator is significantly reduced due to direct sunlight, or in a case where the operator does not see the alarm light, there is a risk that the operator cannot recognize the alarm light. In addition, it is also conceivable to enhance safety by limiting the operation of the work machine when an object is detected in the periphery monitoring of the work machine, but the function of limiting the operation does not always work due to various factors, and there is still room for consideration as the driving assist of the operator in the periphery monitoring.

The present invention has been made in view of the above, and an object of the present invention is to provide a work machine and a periphery monitoring system in which the botheration for an operator can be suppressed while securing the effectiveness of an alarm in periphery monitoring and the safety performance can be enhanced.

Means for Solving the Problem

The application includes a plurality of means for solving the problem, and one example thereof is a work machine including: a machine body; a front work device that is provided in the machine body; an operation device that outputs an operation signal for operating the machine body and the front work device on the basis of operation by an operator; and a sensor that detects an object around the machine body, in which a controller that controls operations of the machine body and the front work device on the basis of the operation signal from the operation device, and performs operation limiting control for limiting the operation of at least one of the machine body and the front work device when the object is detected by the sensor, and an instruction device that instructs the controller to enable or disable the operation limiting control are included, the controller notifies the operator by a first state warning when the object is detected by the sensor and the operation limiting control is disabled by the instruction device, or when the operation device is operated in a state where the object is detected by the sensor and the operation limiting control is enabled by the instruction device, and the controller notifies the operator by a second state warning that is weaker in warning intensity than the first state warning when the operation device is not operated in a state where the object is detected by the sensor and the operation limiting control is enabled by the instruction device.

Advantages of the Invention

According to the present invention, the botheration for an operator can be suppressed while securing the effectiveness of an alarm in periphery monitoring of a work machine and the safety performance can be enhanced.

MODES FOR CARRYING OUT THE INVENTION

Hereinafter, embodiments of the present invention will be described with reference to the drawings. It should be noted that although the embodiments will be described by showing a hydraulic excavator as an example of a work machine, the present invention can be applied to other work machines such as a crane and a wheel loader.

First Embodiment

A first embodiment of the present invention will be described with reference to FIG. 1 to FIG. 5.

Figure 1:
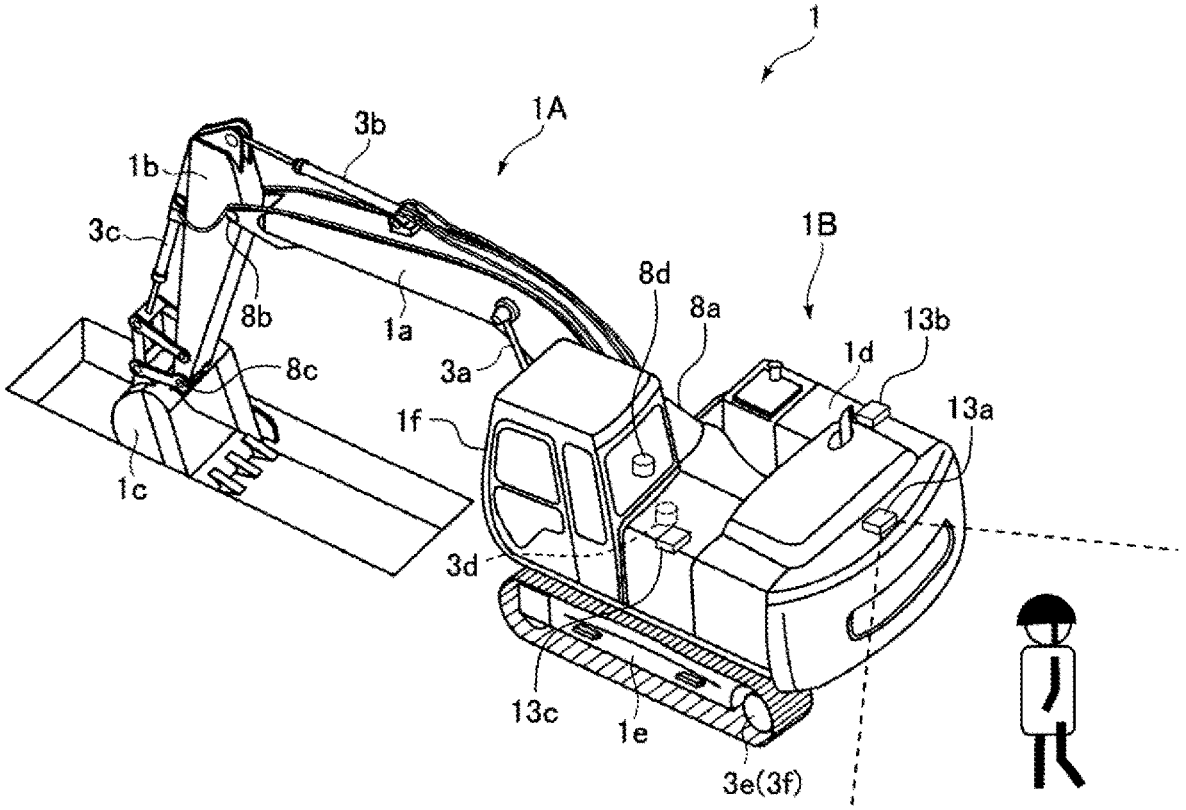
FIG. 1 is a perspective view for roughly showing an external appearance of a hydraulic excavator that is an example of a work machine.

FIG. 1 is a perspective view for roughly showing an external appearance of a hydraulic excavator that is an example of a work machine according to the present embodiment.

In FIG. 1, a hydraulic excavator 1 is roughly configured from a machine body 1B including a crawler type lower track structure 1*e* and an upper swing structure 1*d* swingably provided with respect to the lower track structure 1*e* and a front work device 1A provided on the front side of the upper swing structure 1*d* so as to be capable of being elevated.

The front work device 1A is configured by coupling a plurality of driven members (a boom 1*a*, an arm 1*b*, and a bucket 1*c*) each rotating in the vertical direction. The base end of the boom 1*a* is rotatably supported at the front of the upper swing structure 1*d*. In addition, one end of the arm 1*b* is rotatably coupled to the tip end of the boom 1*a*, and the bucket 1*c* is rotatably coupled to the other end (tip end) of the arm 1*b*. The boom 1*a*, the arm 1*b*, and the bucket 1*c* are driven by a boom cylinder 3*a*, an arm cylinder 3*b*, and a bucket cylinder 3*c*, respectively, that are hydraulic actuators.

The lower track structure 1*e* is configured so as to travel by a pair of crawlers, which are hung around a pair of left and right crawler frames, being driven by travel hydraulic motors 3*e* and 3*f* as hydraulic actuators via a speed reduction mechanism, which is not shown in the drawing, or the like. It should be noted that in FIG. 1, only one of a pair of left and right configurations of the travel hydraulic motors 3*e* and 3*f* is illustrated and denoted by a reference character, only a reference character in parentheses is shown for the other configuration in the drawing, and the illustration thereof is omitted.

The upper swing structure 1*d* is configured by arranging each member on a swing frame serving as a base part, and the swing frame is swingably driven with respect to the lower track structure 1*e* by a swing hydraulic motor 3*d* that is a hydraulic actuator, thus the upper swing structure 1*d* can swing with respect to the lower track structure 1*e*.

Figure 2:
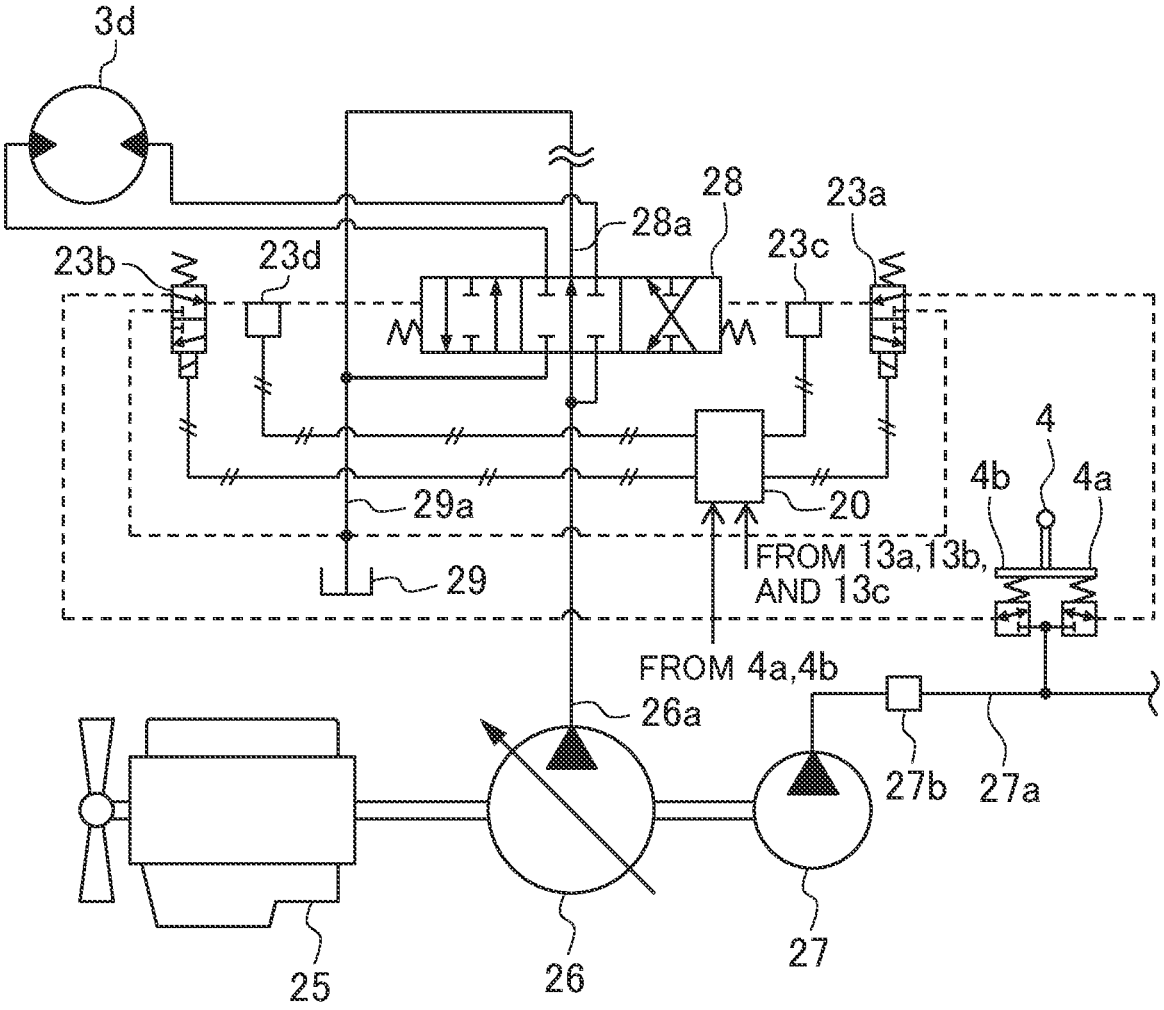
FIG. 2 is a diagram for schematically showing a part of a hydraulic circuit system applied to the hydraulic excavator while being extracted together with a related configuration.

On the front side of the swing frame of the upper swing structure 1*d*, an operation room 1*f* on which an operator boards to operate the hydraulic excavator 1, and an engine 25 as a prime mover, a hydraulic pump 26 and a pilot pump 27 driven by the engine 25, a hydraulic circuit system for driving the respective hydraulic actuators (the travel hydraulic motors 3*e* and 3*f*, the swing hydraulic motor 3*d*, the boom cylinder 3*a*, the arm cylinder 3*b*, and the bucket cylinder 3*c*), and the like are mounted (see FIG. 2). In addition, a controller 20 for controlling the entire operation of the hydraulic excavator 1 is arranged in the upper swing structure 1*d*.

A seat on which the operator sits, an operation device 4 (see FIG. 2) for drive operation of the front work device 1A, swing operation of the upper swing structure 1*d*, travel operation of the lower track structure 1*e*, and the other operations, a gate lock lever, a monitor arranged at a position where the operator sitting on the seat can easily see and which does not obstruct the external visual field, and the like are provided in the operation room 1*f*. It should be noted that the illustration of the configuration arranged in the operation room 1*f* is omitted in FIG. 1.

FIG. 2 is a diagram for schematically showing a part of a hydraulic circuit system applied to the hydraulic excavator while being extracted together with a related configuration. It should be noted that in FIG. 2, a configuration relating to the swing hydraulic motor 3*d* among a plurality of hydraulic actuators of the hydraulic excavator 1 is shown as a representative.

In FIG. 2, the hydraulic circuit system includes the engine 25 as a prime mover, the hydraulic pump 26 and the pilot pump 27 driven by the engine 25, the plurality of hydraulic actuators (only the swing hydraulic motor 3*d* is illustrated in FIG. 2) driven by a hydraulic fluid discharged from the hydraulic pump 26, a plurality of directional control valves (here, only a directional control valve 28 relating to the swing hydraulic motor 3*d* is illustrated) for controlling the flow of the hydraulic fluid supplied from the hydraulic pump 26 to the plurality of hydraulic actuators, and a hydraulic pilot type operation device (here, only the operation device 4 relating to the swing operation is illustrated) that gives instructions on the operations of the plurality of hydraulic actuators and generates a pilot pressure (operation signal) for switching the plurality of directional control valves.

The directional control valve 28 is of a center bypass type and has a center bypass passage located on a center bypass line 28*a*. The center bypass passage is connected in series to the center bypass line 28*a*, communicates with the center bypass line 28*a* when the spool of the directional control valve 28 is in the neutral position, and is interrupted from the center bypass line 28*a* when the spool of the directional control valve 28 is switched to the left or right switching position in FIG. 2. The upstream side of the center bypass line 28*a* is connected to a discharge line 26*a* of the hydraulic pump 26, and the downstream side of the center bypass line 28*a* is connected to a hydraulic tank 29 via a tank line 29*a*.

The operation device 4 is, for example, an operation lever, and has a pair of pilot valves for generating a pilot pressure on the basis of the discharge pressure of the pilot pump 27 according to the operation amount (inclination amount). In addition, the operation device 4 includes operation amount sensors 4*a* and 4*b* for electrically detecting the inclination amount of the operation lever in each direction, that is, the operation amount of the lever, and the operation amounts of the lever sensed by the operation amount sensors 4*a* and 4*b* are output to the controller 20.

The directional control valve 28 is switched by a pilot pressure (operation signal) from the operation device 4. Thus, for example, when the operation device 4 is operated from the neutral position to a direction (for example, the left side) corresponding to the left swing, the pilot pressure generated by one pilot valve is output as an operation signal to a pressure receiving portion of the directional control valve 28 on the right side in FIG. 2 according to the operation amount, thus the directional control valve 28 is switched to the switching position on the right side in FIG. 2 to rotate the swing hydraulic motor 3*d* and the upper swing structure 1*d* is swung in the left direction with respect to the lower track structure 1*e*. On the other hand, for example, when the operation device 4 is operated from the neutral position to a direction (for example, the right side) corresponding to the right swing, the pilot pressure generated by the other pilot valve is output as an operation signal to a pressure receiving portion of the directional control valve 28 on the left side in FIG. 2 according to the operation amount, thus the directional control valve 28 is switched to the switching position on the left side in FIG. 2 to rotate the swing hydraulic motor 3*d* and the upper swing structure 1*d* is swung in the right direction with respect to the lower track structure 1*e*.

Solenoid valves 23*a* and 23*b* are provided in lines from the operation device 4 to the two pressure receiving portions of the directional control valve 28. The solenoid valves 23*a* and 23*b* configure a limiting device for limiting the pilot pressure (operation signal) output from the operation device 4 to the directional control valve 28, and limit the operating speed of the swing hydraulic motor 3*d* as a hydraulic actuator by limiting the pilot pressure (operation signal) on the basis of a solenoid valve current (command signal) from the controller 20 to be described later. Hereinafter, this control is referred to as operation limiting control as needed.

In addition, pressure sensors 23*c* and 23*d* are provided in lines from the solenoid valves 23*a* and 23*b* to the two pressure receiving portions of the directional control valve 28. The pressure sensors 23*c* and 23*d* sense the pressure of the pilot pressure (operation signal) supplied to the directional control valve 28 via the solenoid valves 23*a* and 23*b*, and output the sensed result to the controller 20.

A discharge line 27*a* of the pilot pump 27 is provided with a pilot relief valve (not illustrated) for holding the discharge pressure of the pilot pump 27 constant. In addition, the discharge line 27*a* of the pilot pump 27 is provided with a lock valve 27*b*, and the lock valve 27*b* is switched according to the operation of the gate lock lever provided in the operation room 1*f*. The gate lock lever has a position switch (not illustrated) that is closed when a gate lock lever 4*f* is in the unlocked position (lowered position) and that is opened when the gate lock lever 4*f* is in the locked position (raised position). For example, when the gate lock lever is operated to the lowered position and the position switch is closed, a solenoid portion of the lock valve 27*b* is energized via the position switch and the lock valve 27*b* is switched to the communicating position. Accordingly, the discharge line 27*a* of the pilot pump 27 is communicated, and the discharge pressure of the pilot pump 27 is introduced into the operation device 4 and the like. That is, the pilot pressure can be generated by the operation of the operation device 4 or the like, and the hydraulic actuator can be operated (operable state). On the other hand, when the gate lock lever is operated to the raised position and the position switch is opened, the lock valve 27*b* is switched to the interruption position. Accordingly, the discharge line 27*a* of the pilot pump 27 is interrupted. That is, the pilot pressure is not generated even when the operation device 4 or the like is operated, and the hydraulic actuator is not operated (inoperable state).

It should be noted that the hydraulic circuit system relating to the left and right travel hydraulic motors 3*e* and 3*f*, the boom cylinder 3*a*, the arm cylinder 3*b*, and the bucket cylinder 3*c* that are not illustrated in FIG. 2 has the same configuration as the hydraulic circuit system relating to the swing hydraulic motor 3*d*. For example, solenoid valves 24*a* and 24*b* (see FIG. 4 to be described later) are provided in the lines from the operation device relating to the travel operation to the two pressure receiving portions of the directional control valve of each of the travel hydraulic motors 3*e* and 3*f*, respectively, and the operating speeds of the travel hydraulic motors 3*e* and 3*f* as hydraulic actuators are limited by limiting the pilot pressure (operation signal) on the basis of the solenoid valve current (command signal) from the controller 20 (that is, the operation limiting control is performed).

Figure 3:
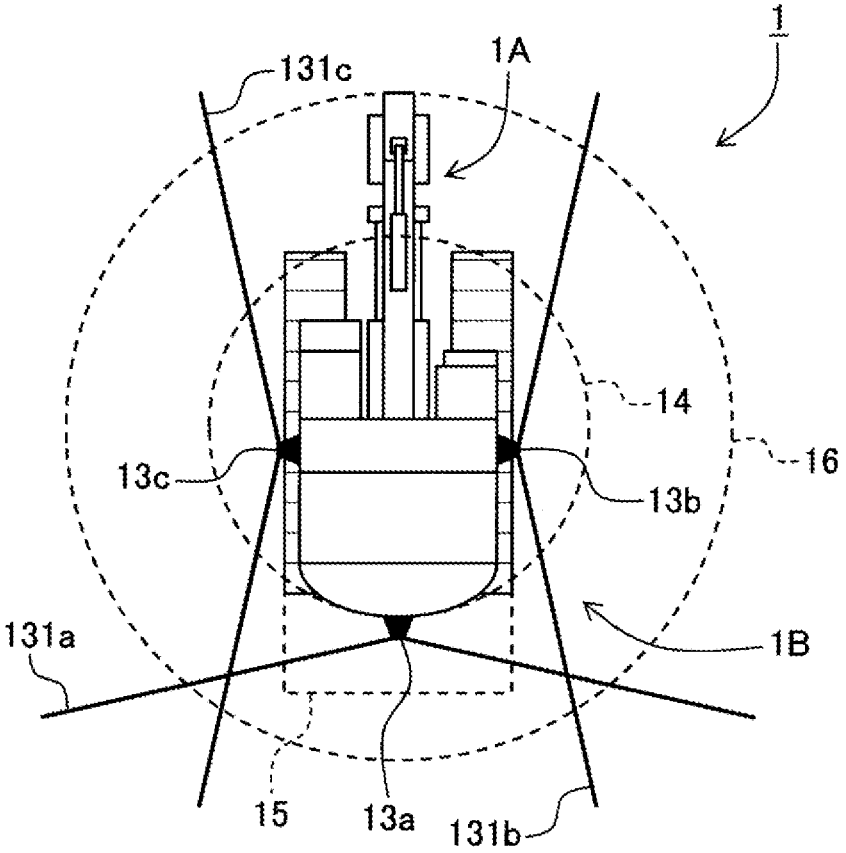
FIG. 3 is a top view for schematically showing the arrangement and detection range of sensors of the hydraulic excavator.

FIG. 3 is a top view for schematically showing the arrangement and detection range of sensors of the hydraulic excavator.

As shown in FIG. 1 and FIG. 3, a plurality of sensors 13*a*, 13*b*, and 13*c* for detecting objects around the upper swing structure 1*d* is mounted on the left, right, and rear sides of the upper portion of the upper swing structure 1*d*. The sensors 13*a*, 13*b*, and 13*c* configure a part of a periphery monitoring system (to be described later) for performing periphery monitoring as the driving assist of the operator in the hydraulic excavator 1. The plurality of sensors 13*a*, 13*b*, and 13*c* is referred to as a rear sensor 13*a*, a right-side sensor 13*b*, and a left-side sensor 13*c*, respectively, according to the arrangement thereof. That is, the plurality of sensors 13*a*, 13*b*, and 13*c* is configured from the rear sensor 13*a* provided on the rear side of the upper swing structure 1*d* and having the rear side of the upper swing structure 1*d* as a detectable range 131*a*, the right-side sensor 13*b* provided on the right side of the upper swing structure 1*d* and having the right side of the upper swing structure 1*d* as a detectable range 131*b*, and the left-side sensor 13*c* provided on the left side of the upper swing structure 1*d* and having the left side of the upper swing structure 1*d* as a detectable range 131*c*.

In addition, as shown in FIG. 3, detection ranges 14, 15, and 16 for detecting objects by the sensors 13*a*, 13*b*, and 13*c* are set around the hydraulic excavator 1. The detection range 14 is a detection range defined on the basis of the swing range of the rear end of the upper swing structure 1*d* in a case where the upper swing structure 1*d* performs a swing operation with respect to the lower track structure 1*e*. The detection range 15 is a detection range defined on the rear side of the lower track structure 1*e* in the travel operation on the basis of the width and traveling speed (travelable speed) of the lower track structure 1*e*. The detection range 16 is a detection range defined on the basis of the swing range of the tip end of the front work device 1A in a case where the upper swing structure 1*d* performs a swing operation with respect to the lower track structure 1*e*.

The sensors 13*a*, 13*b*, and 13*c* are, for example, infrared depth sensors that detect the distance and direction from the sensors 13*a*, 13*b*, and 13*c* to an object and output the position of the detected object in the three-dimensional coordinate system as a detection result. It should be noted that it is only necessary for the sensors 13*a*, 13*b*, and 13*c* to be capable of detecting an object and specifying the position thereof, and for example, a millimeter wave sensor, a sensor using a stereo camera, or the like may be used. Since the attachment positions of the sensors 13*a*, 13*b*, and 13*c* relative to the upper swing structure 1*d* are preliminarily defined by design information or the like, the relative position (relative position in the three-dimensional coordinate system) of the detected object with respect to the upper swing structure 1*d* can be specified from the design information and the detection results of the sensors 13*a*, 13*b*, and 13*c*.

The hydraulic excavator 1 of the present embodiment configured as described above has a periphery monitoring system for monitoring the periphery of the hydraulic excavator 1 on the basis of the detection results of the sensors 13*a*, 13*b*, and 13*c* as the driving assist of the operator.

Figure 4:
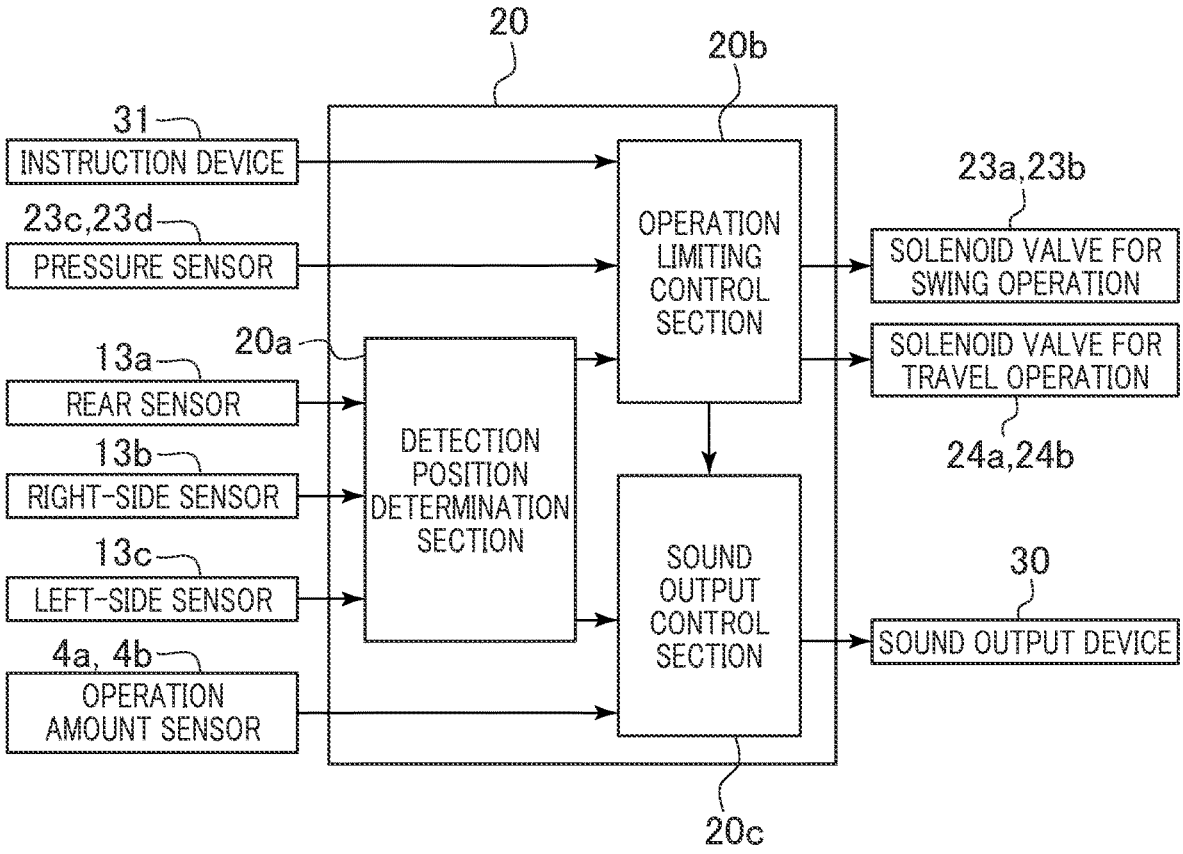
FIG. 4 is a functional block diagram for schematically showing a configuration according to a periphery monitoring system of the hydraulic excavator while being extracted.

FIG. 4 is a functional block diagram for schematically showing a configuration according to the periphery monitoring system of the hydraulic excavator according to the present embodiment while being extracted.

In FIG. 4, the periphery monitoring system is configured from the plurality of sensors 13*a*, 13*b*, and 13*c*, the pressure sensors 23*c* and 23*d*, the operation amount sensors 4*a* and 4*b*, an instruction device 31 for instructing about ON/OFF of the operation limiting control, the solenoid valves 23*a*, 23*b*, 24*a*, and 24*b* as limiting devices, a sound output device 30 as a warning device provided in the operation room 1*f* or the like, and the controller 20 for generating and outputting command signals to the solenoid valves 23*a*, 23*b*, 24*a*, and 24*b* and a command signal to the sound output device 30 on the basis of the detection results of the plurality of sensors 13*a*, 13*b*, and 13*c*.

Here, the limiting devices (solenoid valves 23*a*, 23*b*, 24*a*, and 24*b*) and the warning device (sound output device 30) configure a part of a driving assist device for assisting the driving of the operator.

The limiting device assists the driving of the operator by limiting the travel operation or swing operation of the hydraulic excavator 1 (that is, the operation limiting control is performed) under the control of the controller 20 according to the detection results of the sensors 13*a*, 13*b*, and 13*c*. The instruction device 31 is provided in, for example, the operation room 1*f* and gives instructions whether the function of the operation limiting control is enabled (ON) or disabled (OFF) by the operation of the operator.

The sound output device 30 that is a warning device assists the driving of the operator by transmitting sound information on the basis of the control by the controller 20 according to the detection results of the sensors 13*a*, 13*b*, and 13*c*. The sound output device 30 can output various sounds (sound information) in response to a command from the controller 20. The sound output by the sound output device 30 includes, for example, a first state sound and a second state sound. Both the first state sound and the second state sound have an alarm (warning) effect, and it is assumed that the first state sound is stronger in the alarm effect (warning intensity) than the second state sound. Specifically, for example, it is conceivable that the first state sound is made louder, the sound pressure is made higher, or the frequency is made more recognizable to a person than the second state sound.

It should be noted that it is only necessary for the sound output device 30 to be capable of outputting at least two kinds of sounds (sounds, buzzer sounds, melodies, and the like) of the first state sound and the second state sound, and the sound output device 30 is, for example, a speaker, a buzzer, or the like. In addition, as the sound output device 30, two or more kinds of speakers or buzzers that are different in volume, sound pressure, sound quality, or the like may be used in combination, or an input signal may be changed by one speaker or buzzer to change the volume, sound pressure, sound quality, or the like.

In addition, although a case where the sound output device 30 is used as a warning device will be exemplified and described in the present embodiment, one that can be used as a warning device as long as it can issue warnings (for example, a first state warning and a second state warning) that are different in warning intensity to the operator. That is, for example, instead of the sound output device 30, a display device capable of displaying various kinds of information may be provided as a warning device, and a warning may be issued to the operator by way of a first state display and a second state display that are different in warning intensity. In this case, a warning is issued to the operator by displaying, for example, the first state display that is stronger in warning intensity than the second state display, and the second state display. In addition, for example, instead of the sound output device 30, a light emitting device capable of emitting light in various kinds of states may be provided as a warning device, and a warning may be issued to the operator by way of first state light and second state light that are different in warning intensity. In this case, a warning is issued to the operator by emitting, for example, the first state light that is stronger in warning intensity than the second state light, and the second state light. In addition, for example, instead of the sound output device 30, a vibration device capable of notifying the operator of information by way of various kinds of vibrations may be provided as a warning device, and a warning may be issued to the operator by way of a first state vibration and a second state vibration that are different in warning intensity. In this case, a warning is issued to the operator by way of, for example, the first state vibration that is stronger in warning intensity than the second state vibration, and the second state vibration. In addition, warnings (for example, a first state warning and a second state warning) that are different in warning intensity may be issued to the operator by using a combination thereof.

The controller 20 has a detection position determination section 20*a*, an operation limiting control section 20*b*, and a sound output control section 20*c* as functional sections relating to the periphery monitoring system.

The detection position determination section 20*a* determines the detection position of the detected object on the basis of the detection results of the sensors 13*a*, 13*b*, and 13*c*, and outputs the determination result to the operation limiting control section 20*b* and the sound output control section 20*c*. In addition, the detection position determination section 20*a* has information about the detection ranges 14, 15, and 16, and can determine the position of the detected object among the detection ranges 14, 15, and 16 by comparing the detection results (position information) of the sensors 13*a*, 13*b*, and 13*c* with the detection ranges 14, 15, and 16.

The operation limiting control section 20*b* controls, when an instruction to turn on the operation limiting control (to enable the function) is given by the operation of the instruction device 31 by the operator, the solenoid valves 23*a*, 23*b*, 24*a*, and 24*b* as the limiting devices for limiting the operation signal output from the operation device 4 on the basis of the determination result of the detection position determination section 20*a*, that is, the position of the detected object among the detection ranges 14, 15, and 16, thus at least either the travel operation of the lower track structure 1*e* or the swing operation of the upper swing structure 1*d* with respect to the lower track structure 1*e* is limited. For example, when the detection range 14 is set as a detection target range during the swing operation of the upper swing structure 1*d* and an object is detected in the detection range 14, a command signal is output to the solenoid valves 23*a* and 23*b* to limit the swing operation of the upper swing structure 1*d*. In addition, when the detection range 15 is set as a detection target range during the travel operation of the lower track structure 1*e* and an object is detected in the detection range 15, a command signal is output to the solenoid valves 24*a* and 24*b* to limit the travel operation of the lower track structure 1*e*. It should be noted that when an instruction to turn off the operation limiting control (to disable the function) is given by the operation of the instruction device 31 by the operator, the operation limiting control section 20*b* does not perform the control of the solenoid valves 23*a*, 23*b*, 24*a*, and 24*b*, that is, the operation limiting control.

In addition, the operation limiting control section 20*b* determines whether or not the operation limiting control is enabled, that is, whether or not the solenoid valves 23*a* and 23*b* are normally operating on the basis of the sensed results from the pressure sensors 23*c* and 23*d*. Specifically, when the operation limiting control is ON, an object is detected by the sensors 13*a*, 13*b*, and 13*c*, and a command signal is output from the operation limiting control section 20*b* to the solenoid valves 23*a*, 23*b*, 24*a*, and 24*b* in order to perform the operation limiting control of the swing operation and the travel operation, that is, when the control for limiting (decompressing) the pilot pressure to the directional control valve 28 or the like is performed, it is determined whether the operation limiting control is enabled (normal) or disabled (abnormal) by determining whether or not the pressure of the pilot pressure via the solenoid valves 23*a*, 23*b*, 24*a*, and 24*b* is limited (decompressed) to a predetermined pressure or less. The operation limiting control section 20*b* outputs the determination result of whether or not the operation limiting control is enabled, that is, whether each of the solenoid valves 23*a*, 23*b*, 24*a*, and 24*b* is normal or abnormal to the sound output control section 20*c*.

The sound output control section 20*c* controls the sound output device 30 on the basis of the determination result of the detection position determination section 20*a*, the determination result of the operation limiting control section 20*b*, and the sensed results of the operation amount sensors 4*a* and 4*b* to notify the operator of the detection content.

Figure 5:
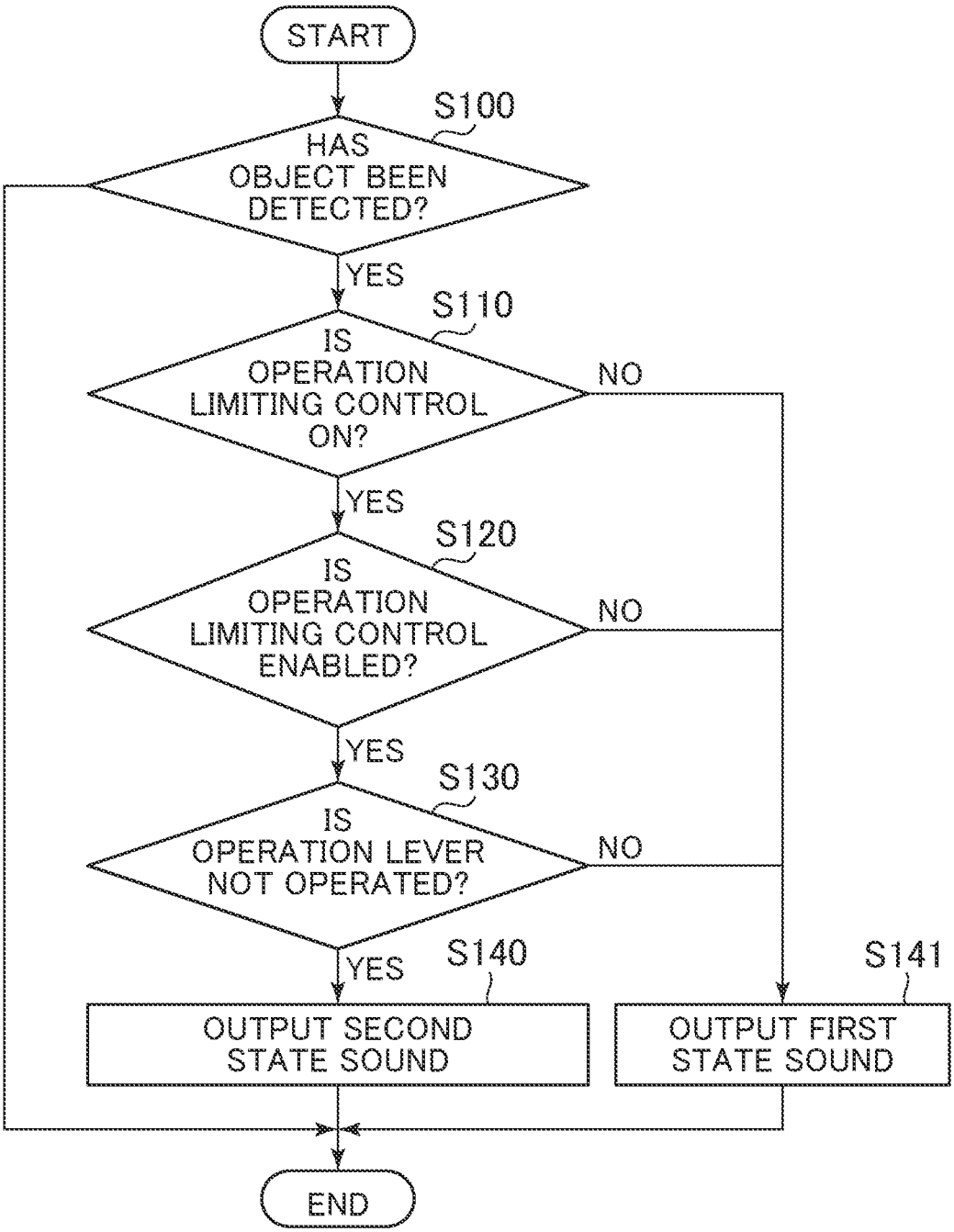
FIG. 5 is a flowchart for showing the processing content of a controller according to a first embodiment.

FIG. 5 is a flowchart for showing the processing content of the controller.

In FIG. 5, the operation limiting control section 20*b* and the sound output control section 20*c* of the controller 20 first determine whether or not an object has been detected on the basis of the determination result from the detection position determination section 20*a* (Step S100), and the process is terminated when the determination result is NO.

In addition, when the determination result in Step S100 is YES, the operation limiting control section 20*b* determines whether or not the operation limiting control is ON (Step S110), and determines whether or not the operation limiting control is enabled when the determination result is YES (Step S120). When the determination result in Step S120 is YES, the sound output control section 20*c* determines whether or not the operation device 4 is operated on the basis of the sensed results from the operation amount sensors 4*a* and 4*b* (Step S130), and outputs the second state sound by controlling the sound output device 30 when the determination result is YES (Step S140), then terminating the process.

In addition, when the determination result in Step S110 is NO, that is, when the operation limiting control is OFF, the first state sound is output (Step S141), and the process is terminated. In addition, when the determination result in Step S120 is NO, that is, when the operation limiting control is disabled (abnormal), the first state sound is output (Step S141), and the process is terminated. In addition, when the determination result in Step S130 is NO, that is, when the operation device 4 is operated, the first state sound is output (Step S141), and the process is terminated.

It should be noted that the processes (Step S100 to Step S141) shown in FIG. 5 are continuously and repeatedly executed on the basis of a base clock or the like relating to the operation of the controller 20 in a state where the hydraulic excavator 1 is activated.

The effect of the present embodiment configured as described above will be described.

In the prior art, in a situation where the operator recognizes that a predetermined object to be monitored exists around the work machine, the botheration for the operator is suppressed by switching the alarm sound to alarm light. However, for example, in a case where the visibility of the alarm light from the operator is significantly reduced by direct sunlight, or in a case where the operator does not see the alarm light, there is a risk that the operator cannot recognize the alarm light. In addition, in periphery monitoring of the work machine, it is conceivable to enhance safety by performing the operation limiting control for limiting the operation of the work machine when an object is detected, but the operation limiting control does not necessarily work when the operation limiting control is disabled (OFF) or when an abnormality occurs in the function of the operation limiting control.

On the other hand, in the present embodiment, in a case where an object is detected by the sensors 13*a*, 13*b*, and 13*c*, when the possibility of contact between the work machine and the object potentially increases, such as when the operation limiting control is OFF (disabled), when the operation limiting control is abnormal, or when the operation device 4 is operated, the detection of the object is notified to the operator by the first state sound (the sound whose warning intensity is relatively stronger than the second state), thus the operator can more surely notice the alarm. Further, when the operation limiting control is normal and the operation device 4 is not operated, the detection of the object is notified to the operator by the second state sound (the sound whose warning intensity is relatively weaker than the first state) different from the first state sound, thus the botheration for the operator can be suppressed while securing the effectiveness of the alarm in the periphery monitoring.

That is, for example, in a case where an alarm is sounding by detecting an object, if the operator is not aware of the alarm, or if the operator is aware of the alarm but becomes less conscious of the alarm with the elapse of a certain period of time, there is a risk that the operation lever is operated. Therefore, in such a case, the effectiveness of the alarm can be improved by raising the alarm level when the operation lever is operated, that is, by transmitting sound information having a large alarm effect to the operator.

In addition, in the case of a work machine that performs a swing operation such as a hydraulic excavator, the range (that is, the range where an object should be detected) where the prevention of contact between the object and the work machine should be considered differs between the swing operation and the travel operation. For example, as shown in FIG. 3, the range where the contact between the work machine and the object should be considered is the detection range 14 in the swing operation, and the detection range 15 in the travel operation. Therefore, where an object is detected in the detection range 15, it can be said that the operation of the operation device for the swing operation is a low-risk operation and the operation of the operation device for the travel operation is a high-risk operation. As described above, in the case of a high-risk lever operation, the alarm effect is increased (the warning intensity is increased), and in the case of a low-risk lever operation, the alarm effect is decreased (the warning intensity is decreased), thus the botheration for the operator can be reduced and safety can be enhanced.

In addition, in the present embodiment, when the operation limiting control is ON and there is no lever operation even when the operation limiting control is enabled as shown in, for example, FIG. 5, there is no possibility of contact between the detected object and the hydraulic excavator 1 (the front work device 1A and the machine body 1B), and thus the second state sound that is weaker in warning intensity than the first state sound is used. Therefore, the operator is not notified of a sound having an unreasonably strong warning intensity against a risk, and the botheration for the operator can be reduced.

In addition, the safety of the entire periphery monitoring system can be further improved because the present embodiment is configured such that the pressure sensors for sensing the pilot pressure introduced to the pressure receiving portions of the directional control valve relating to the swing operation and the travel operation are provided, the effectiveness of the operation limiting control is monitored by determining whether or not the operation limiting control is enabled from the sensed results of the pressure sensors, and even in a case where the solenoid valves for limiting the pilot pressure input to the pressure receiving portions of the directional control valve do not operate due to an abnormality such as a failure when the operation limiting control is ON, the abnormality of the operation limiting control is notified to the operator by notifying the operator of the first state sound that is stronger in warning intensity.

Second Embodiment

A second embodiment of the present invention will be described with reference to FIG. 6.

In the embodiment, a way of outputting the sound is changed according to the operation target of the operation device.

Figure 6:
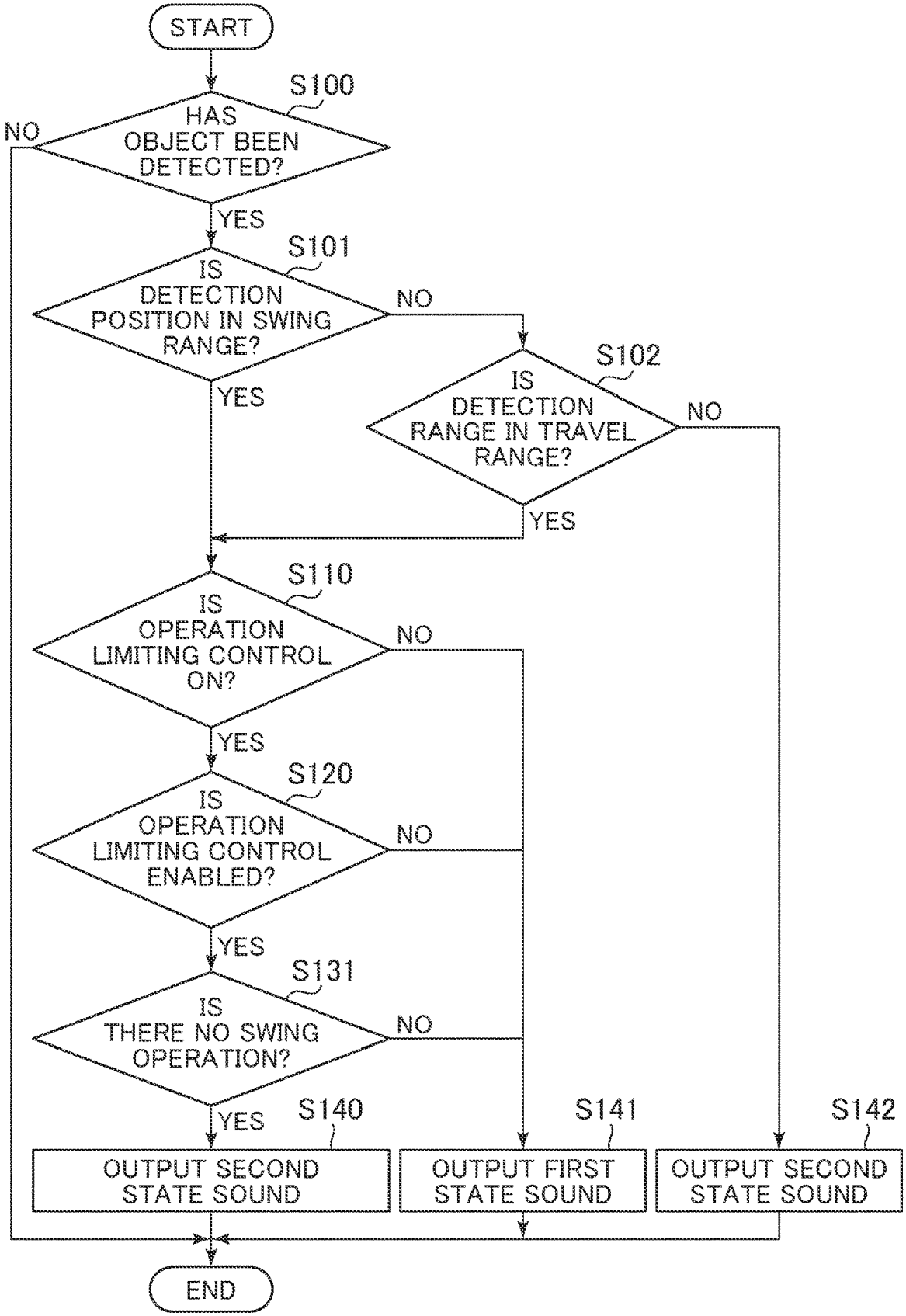
FIG. 6 is a flowchart for showing the processing content of a controller according to a second embodiment.

FIG. 6 is a flowchart for showing the processing content of the controller according to the present embodiment. In the drawing, the members similar to those in the first embodiment are denoted by the same reference characters, and the description thereof will be omitted.

In FIG. 6, the operation limiting control section 20*b* and the sound output control section 20*c* of the controller 20 first determine whether or not an object has been detected on the basis of the determination result from the detection position determination section 20*a* (Step S100), and the process is terminated when the determination result is NO.

In addition, when the determination result in Step S100 is YES, that is, when an object has been detected, it is determined whether or not the detection position is in the detection range 14 (see FIG. 3) that is the range relating to the swing operation (Step S101) and whether or not the detection position is in the detection range 15 (see FIG. 3) that is the range relating to the travel operation (Step S102), and the sound output control section 20*c* outputs the second state sound (Step S142) when both of the determination results in Steps S101 and S102 are NO, then terminating the process.

In addition, when at least one of the determination results in Steps S101 and S102 is YES, that is, when the detection position of the object is at least one of the detection ranges 14 and 15, the operation limiting control section 20*b* determines whether or not the operation limiting control is ON (Step S110), and determines whether or not the operation limiting control is enabled (Step S120) when the determination result is YES. When the determination result in Step S120 is YES, the sound output control section 20*c* determines whether or not the operation device 4 is operated on the basis of the sensed results from the operation amount sensors 4*a* and 4*b* (Step S131), and outputs the second state sound by controlling the sound output device 30 (Step S140) when the determination result is YES, then terminating the process.

In addition, when the determination result in Step S110 is NO, that is, when the operation limiting control is OFF, the first state sound is output (Step S141), and the process is terminated. In addition, when the determination result in Step S120 is NO, that is, when the operation limiting control is disabled (abnormal), the first state sound is output (Step S141), and the process is terminated. In addition, when the determination result in Step S131 is YES, that is, when the operation device 4 is operated, the first state sound is output (Step S141), and the process is terminated.

It should be noted that the processes (Step S100 to Step S142) shown in FIG. 6 are continuously and repeatedly executed on the basis of a base clock or the like relating to the operation of the controller 20 in a state where the hydraulic excavator 1 is activated.

The other configurations are the same as those of the first embodiment.

Even in the present embodiment configured as described above, the same effect as that in the first embodiment can be obtained.

The features of the present embodiment configured as described above will be described.

(1) The above-described embodiment provides a work machine (for example, a hydraulic excavator 1) including: a machine body 1B; a front work device 1A that is provided in the machine body; an operation device 4 that outputs an operation signal for operating the machine body and the front work device on the basis of operation by an operator; and sensors 13*a*, 13*b*, and 13*c* that detect an object around the machine body, in which a controller 20 that controls operations of the machine body and the front work device on the basis of the operation signal from the operation device, and performs operation limiting control for limiting the operation of at least one of the machine body and the front work device when the object is detected by the sensors, and an instruction device 31 that instructs the controller to enable or disable the operation limiting control are included, the controller notifies the operator by a first state warning when the object is detected by the sensors and the operation limiting control is disabled by the instruction device, or when the operation device is operated in a state where the object is detected by the sensors and the operation limiting control is enabled by the instruction device, and the controller notifies the operator by a second state warning that is weaker in warning intensity than the first state warning when the operation device is not operated in a state where the object is detected by the sensors and the operation limiting control is enabled by the instruction device.

Accordingly, the botheration for the operator can be suppressed while securing the effectiveness of the alarm in the periphery monitoring of the work machine, and the safety performance can be enhanced.

(2) In addition, the above-described embodiment provides the work machine (for example, the hydraulic excavator 1) of (1), in which the machine body 1B has a lower track structure 1*e* and an upper swing structure 1*d* swingably provided with respect to the lower track structure, and the controller 20 receives an instruction signal from the instruction device when the object is detected in a predetermined detection range on the basis of a swing range of the upper swing structure, and notifies the operator by the first state warning when the swing operation of the upper swing structure is operated by the operation device.

(3) In addition, the above-described embodiment provides the work machine (for example, the hydraulic excavator 1) of (1), in which the first state warning and the second state warning are sounds.

(4) In addition, the above-described embodiment provides the work machine (for example, the hydraulic excavator 1) of (1), including: a plurality of hydraulic actuators 3*d*, 3*e*, and 3*f* that drives the machine body 1B and the front work device 1A; a directional control valve 28 that controls flow rate of a hydraulic fluid supplied from a hydraulic pump 26 to each of the plurality of hydraulic actuators; limiting devices (for example, solenoid valves 23*a*, 23*b*, 24*a*, and 24*b*) that limit the operation of at least one of the machine body and the front work device by reducing a pilot pressure as the operation signal for controlling the directional control valve; and pressure sensors 23*c* and 23*d* that sense magnitude of the pilot pressure as the operation signal supplied to the directional control valve via the limiting devices, in which the controller determines that an instruction signal from the instruction device has been received when the pilot pressure as the operation signal is lower than a predetermined reference pressure, and determines that an instruction signal from the instruction device has not been received when the pilot pressure as the operation signal is equal to or higher than the reference pressure.

(5) In addition, the above-described embodiment provides a periphery monitoring system for a work machine (for example, a hydraulic excavator 1), including: a machine body 1B; a front work device 1A that is provided in the machine body; and an operation device 4 that outputs an operation signal for operating the machine body and the front work device, in which sensors 13*a*, 13*b*, and 13*c* that detect an object around the machine body, and a controller 20 that has a control function for controlling operation of the machine body or the front work device when receiving a detection signal from the sensors are included, the controller determines whether or not the control function is enabled and whether or not the operation device is operated when receiving the detection signal, when it is determined that the control function is disabled or when it is determined that the control function is enabled and the operation device is operated, a command for issuing a first state warning is transmitted, and when it is determined that the control function is enabled and it is determined that the operation device is not operated, a command for issuing a second state warning that is weaker in warning intensity than the first state warning is transmitted.

<Supplementary Note>

It should be noted that the present invention is not limited to the above-described embodiments, and includes various modified examples and combinations without departing from the gist thereof. In addition, the present invention is not limited to one including all the configurations described in the above embodiments, and includes one in which a part of the configurations is deleted. In addition, some or all of the above-described configurations, functions, and the like may be realized by designing with, for example, integrated circuits. In addition, each of the above-described configurations, functions, and the like may be realized by software in such a manner that a processor interprets and executes a program for realizing each function.

DESCRIPTION OF REFERENCE CHARACTERS

1: Hydraulic excavator
1A: Front work device
1B: Machine body
1*a*: Boom
1*b*: Arm
1*c*: Bucket
1*d*: Upper swing structure
1*e*: Lower track structure
1*f*: Operation room
3*a*: Boom cylinder
3*b*: Arm cylinder
3*c*: Bucket cylinder
3*d*: Swing hydraulic motor
3*e*: Travel hydraulic motor
3*f*: Travel hydraulic motor
4: Operation device
4*a*, 4*b*: Operation amount sensor
4*f*: Gate lock lever
13*a*: Rear sensor
13*b*: Right-side sensor
13*c*: Left-side sensor
14, 15, 16: Detection range
20: Controller
20*a*: Detection position determination section
20*b*: Operation limiting control section
20*c*: Sound output control section
23*a*, 23*b*, 24*a*, 24*b*: Solenoid valve
23*b*, 23*d*: Pressure sensor
25: Engine
26: Hydraulic pump
26*a*: Discharge line
27: Pilot pump
27*a*: Discharge line
27*b*: Lock valve
28: Directional control valve
28*a*: Center bypass line
29: Hydraulic tank
29*a*: Tank line
30: Sound output device
31: Instruction device
131*a*, 131*b*, 131*c*: Detectable range

The invention claimed is:

1. A work machine comprising:
a machine body;
a front work device that is provided in the machine body;
an operation device that outputs an operation signal for operating the machine body and the front work device on a basis of operation by an operator; and
a sensor that detects an object around the machine body, wherein
a controller that controls operations of the machine body and the front work device on a basis of the operation signal from the operation device, and performs operation limiting control for limiting the operation of at least one of the machine body and the front work device when the object is detected by the sensor, and
an instruction device that instructs the controller to enable or disable the operation limiting control are included,
the controller notifies the operator by a first state warning when the object is detected by the sensor and the operation limiting control is disabled by the instruction device, or when the operation device is operated in a state where the object is detected by the sensor and the operation limiting control is enabled by the instruction device, and
the controller notifies the operator by a second state warning that is weaker in warning intensity than the first state warning when the operation device is not operated in a state where the object is detected by the sensor and the operation limiting control is enabled by the instruction device.

2. The work machine according to claim 1, wherein
the machine body has a lower track structure and an upper swing structure swingably provided with respect to the lower track structure, and
the controller receives an instruction signal from the instruction device when the object is detected in a predetermined detection range on a basis of a swing range of the upper swing structure, and notifies the operator by the first state warning when swing operation of the upper swing structure is operated by the operation device.

3. The work machine according to claim 1, wherein
the first state warning and the second state warning are sounds.

4. The work machine according to claim 1, comprising:
a plurality of hydraulic actuators that drives the machine body and the front work device;
a directional control valve that controls flow rate of a hydraulic fluid supplied from a hydraulic pump to each of the plurality of hydraulic actuators;
a limiting device that limits the operation of at least one of the machine body and the front work device by reducing a pilot pressure as the operation signal for controlling the directional control valve; and
a pressure sensor that senses magnitude of the pilot pressure as the operation signal supplied to the directional control valve via the limiting device, wherein
the controller determines that an instruction signal from the instruction device has been received when the pilot pressure as the operation signal is lower than a predetermined reference pressure, and determines that an instruction signal from the instruction device has not been received when the pilot pressure as the operation signal is equal to or higher than the reference pressure.

5. A periphery monitoring system for a work machine, comprising:

a machine body;

a front work device that is provided in the machine body; and an operation device that outputs an operation signal for operating the machine body and the front work device, wherein a sensor that detects an object around the machine body, and a controller that has a control function for controlling operation of the machine body or the front work device when receiving a detection signal from the sensor are included, the controller determines whether or not the control function is enabled and whether or not the operation device is operated when receiving the detection signal, when it is determined that the control function is disabled or when it is determined that the control function is enabled and the operation device is operated, a command for issuing a first state warning is transmitted, and when it is determined that the control function is enabled and it is determined that the operation device is not operated, a command for issuing a second state warning that is weaker in warning intensity than the first state warning is transmitted.

* * * * *